US009611815B2

(12) United States Patent
Jentz et al.

(10) Patent No.: US 9,611,815 B2
(45) Date of Patent: Apr. 4, 2017

(54) FUEL SYSTEM CONTROL

(71) Applicant: Ford Global Technologies, LLC, Dearborn, MI (US)

(72) Inventors: Robert Roy Jentz, Westland, MI (US); John Mullins, Belleville, MI (US); Aed M. Dudar, Canton, MI (US); Mark W. Peters, Wolverine Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/074,331

(22) Filed: Mar. 18, 2016

(65) Prior Publication Data

US 2016/0201614 A1 Jul. 14, 2016

Related U.S. Application Data

(62) Division of application No. 13/773,461, filed on Feb. 21, 2013, now Pat. No. 9,303,599.

(51) Int. Cl.

| | |
|---|---|
| ***F02M 33/02*** | (2006.01) |
| ***F02M 25/08*** | (2006.01) |
| ***F02M 37/00*** | (2006.01) |

(52) U.S. Cl.

CPC .... *F02M 25/0836* (2013.01); *F02M 25/0854* (2013.01); *F02M 25/0872* (2013.01); *F02M 37/0064* (2013.01)

(58) Field of Classification Search

CPC ..... F02D 19/0621; F02D 41/0032; F02D 41/004; F02D 41/0045

USPC ..... 123/516, 518, 519, 520, 198 D; 180/314

See application file for complete search history.

(56) References Cited

U.S. PATENT DOCUMENTS

| | | | | |
|---|---|---|---|---|
| 5,295,472 | A | 3/1994 | Otsuka et al. | |
| 5,592,923 | A | 1/1997 | Machida | |
| 6,334,355 | B1 | 1/2002 | Grieve et al. | |
| 2001/0029931 | A1 | 10/2001 | Burke et al. | |
| 2013/0253799 | A1 | 9/2013 | Peters et al. | |
| 2014/0026866 | A1 | 1/2014 | Pifher et al. | |
| 2014/0095049 | A1* | 4/2014 | Jentz | F02M 25/0818 701/101 |
| 2014/0130781 | A1 | 5/2014 | Jentz et al. | |
| 2014/0230795 | A1* | 8/2014 | Jentz | F02M 25/0854 123/520 |
| 2014/0311461 | A1* | 10/2014 | Dudar | F02M 25/0818 123/520 |
| 2015/0090232 | A1* | 4/2015 | Peters | F02M 25/0854 123/520 |
| 2015/0090233 | A1* | 4/2015 | Dudar | F02M 25/0854 123/520 |

* cited by examiner

*Primary Examiner* — John Kwon

(74) *Attorney, Agent, or Firm* — James Dottavio McCoy Russell LLP

(57) ABSTRACT

Methods are provided for reliving excess vacuum from a fuel tank. In response to elevated fuel tank vacuum levels, a canister purge valve is opened to dissipate the vacuum to an engine intake manifold while the engine is not combusting. Alternatively, the purge valve is opened to dissipate the excess vacuum to the intake manifold while the engine is combusting during conditions when the likelihood of air-fuel ratio errors are lower or when any incurred errors are better tolerated.

2 Claims, 4 Drawing Sheets

FUEL SYSTEM CONTROL

CROSS REFERENCE TO RELATED APPLICATIONS

The present application is a divisional of U.S. patent application Ser. No. 13/773,461, entitled "FUEL SYSTEM CONTROL," filed on Feb. 21, 2013, the entire contents of which are hereby incorporated by reference for all purposes.

FIELD

The present description relates to systems and methods for relieving excess fuel system vacuum in a vehicle, such as a hybrid vehicle.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel.

During some conditions, excessive vacuum can build inside the evaporative emission control system. For example, due to degradation of a canister purge solenoid or a canister vent solenoid, or due to a restriction in the system's fresh air line, fuel tank vacuum levels may become excessive, potentially harming the fuel tank. While evaporative emission control systems may include hardware, such as fuel caps, to relieve excess vacuum, there may be conditions where relief is not provided due to hardware malfunction. Likewise, there may be conditions when mitigating steps taken to address the excess vacuum do not provide the desired level of relief. For example, when the excessive vacuum is due to a stuck open canister purge valve, commanding the purge valve to close may not shut off the vacuum supply from the engine's intake manifold. Consequently, fuel tank vacuum level may continue to rise to dangerous levels. In addition to costly fuel tank repairs and an increase in MIL warranty, this can also result in increased operator dissatisfaction.

The inventors herein have recognized that fuel tank damage can be reduced if the trapped vacuum can be vented as soon as an elevated vacuum level is observed. In one example, this may be achieved by a method for a fuel system coupled to an engine, comprising: in response to fuel tank vacuum level, opening a canister purge valve to dissipate excess fuel tank vacuum into an engine intake manifold while the engine is not combusting, a timing of the opening based on engine operating conditions. In this way, fuel tank vacuum levels can be reliably returned to safer levels.

In one example, during engine running conditions, a fuel tank vacuum may be monitored. In response to a rise in fuel tank vacuum levels (e.g., fuel tank vacuum being higher than a threshold level and/or a rate of rise in fuel tank vacuum level being higher than a threshold rate), it may be determined that fuel tank vacuum needs to be vented to reduce potential fuel tank damage. To relieve the excess vacuum, a canister purge valve may be opened so that the vacuum can be dissipated to the engine intake manifold. A timing of opening of the canister purge valve may be opened based on engine operating conditions. For example, in embodiments where the vehicle is a hybrid vehicle, the canister purge valve may be opened after shifting the vehicle from an engine mode to a battery mode of operation. As another example, the valve may be opened after the vehicle has reached an idle status with the engine not running (e.g., an idle-stop). Alternatively, the fuel tank vacuum may be vented to a combusting engine opportunistically when the purge air inlet pressures are closer to atmospheric pressure levels than the fuel tank. In addition, throttle and fuel adjustments may be concomitantly used to allow a driver torque demand to be met while the vacuum is vented.

In this way, by monitoring changes in vacuum level of an isolated fuel tank, fuel tank vacuum build-up can be detected and addressed before fuel tank degradation is incurred. By venting the excess vacuum to the engine while the engine is not combusting, air-fuel errors are averted. Alternatively, by selectively venting the excess vacuum to the intake while the engine is combusting and when the purge air inlet pressures are closer to atmosphere than the fuel tank, air-fuel errors are reduced. By rapidly and reliably addressing excess fuel tank vacuum, fuel tank degradation can be reduced and fuel system integrity can be better maintained.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

Figure 1:
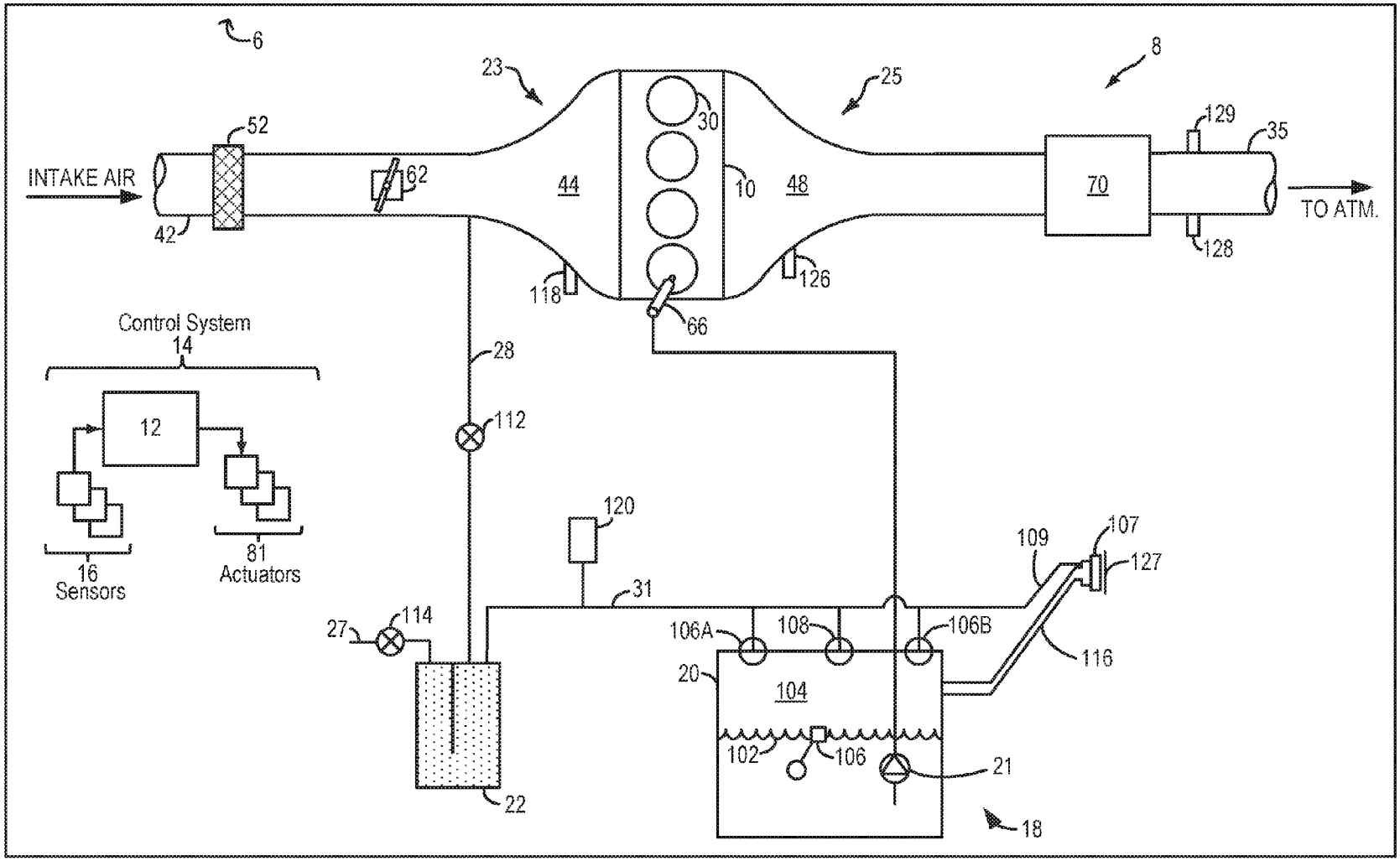
FIG. 1 shows a schematic depiction of a vehicle fuel system.

Methods and systems are provided for venting vacuum from a fuel system coupled to a vehicle engine, such as the fuel system of FIG. 1. A controller may be configured to perform a control routine, such as the example routines of FIGS. 2-3, to open a canister purge valve and relieve excess fuel tank vacuum to an engine intake manifold while an engine is not combusting. Alternatively, the controller may be configured to perform a control routine, such as the example routine of FIG. 4, to open a canister purge valve and relieve excess fuel tank vacuum to an engine intake manifold when the intake manifold vacuum is lower than the fuel tank vacuum, and while the engine is combusting. Fuel and/or throttle adjustments may be performed while the vacuum is dissipated to the combusting engine, as shown at FIG. 5, to reduce air-fuel errors. In this way, fuel tank degradation due to excessive vacuum build-up can be averted.

FIG. 1 shows a schematic depiction of a vehicle system 6. In one example, as depicted, vehicle system 6 is a hybrid electric vehicle system that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device. In alternate examples, vehicle system 6 may be a non-hybrid vehicle system, such as a conventional internal combustion engine vehicle system.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

When configured as a hybrid vehicle system, the vehicle system may be operated in various modes. The various modes may include a full hybrid mode or battery mode, wherein the vehicle is driven by power from only the battery. The various modes may further include an engine mode wherein the vehicle is propelled with power derived only from the combusting engine. Further, the vehicle may be operated in an assist or mild hybrid mode wherein the engine is the primary source of torque and the battery selectively adds torque during specific conditions, such as during a tip-in event. A controller may shift vehicle operation between the various modes of operation based at least on vehicle torque/power requirements and the battery's state of charge. For example, when the power demand is higher, the engine mode may be used to provide the primary source of energy with the battery used selectively during power demand spikes. In comparison, when the power demand is lower and while the battery is sufficiently charged, the vehicle may be operated in the battery mode to improve vehicle fuel economy. Further, as elaborated herein, during conditions when a fuel tank vacuum level is elevated, the vehicle may be shifted from the engine mode of operation to the battery mode of operation to enable excess fuel tank vacuum to be vented to the engine's intake manifold without causing air-fuel ratio disturbances.

Engine system 8 is coupled to a fuel system 18. Fuel system 18 includes a fuel tank 20 coupled to a fuel pump 21 and a fuel vapor canister 22. Fuel tank 20 receives fuel via a refueling line 116, which acts as a passageway between the fuel tank 20 and a refueling door 127 on an outer body of the vehicle. During a fuel tank refueling event, fuel may be pumped into the vehicle from an external source through refueling inlet 107 which is normally covered by a gas cap. During a refueling event, one or more fuel tank vent valves 106A, 106B, 108 (described below in further details) may be open to allow refueling vapors to be directed to, and stored in, canister 22. Further, gas cap may enable fuel tank vacuum or pressure relief via, for example, a poppet valve. In other embodiments, the fuel system may be capless.

Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

In some embodiments, engine 10 may be configured for selective deactivation. For example, engine 10 may be selectively deactivatable responsive to idle-stop conditions. Therein, responsive to any or all of idle-stop conditions being met, the engine may be selectively deactivated by deactivating cylinder fuel injectors. As such, idle-stop conditions may be considered met if the engine is combusting while a system battery (or energy storage device) is sufficiently charged, if auxiliary engine loads (e.g., air conditioning requests) are low, engine temperatures (intake temperature, catalyst temperature, coolant temperature, etc.) are within selected temperature ranges where further regulation is not required, and a driver requested torque or power demand is sufficiently low. In response to idle-stop conditions being met, the engine may be selectively and automatically deactivated via deactivation of fuel and spark. The engine may then start to spin to rest. Further, as elaborated herein, during conditions when fuel tank vacuum is elevated, the engine may be actively pulled-down, or deactivated, so as to enable the fuel tank vacuum to be vented to the deactivated engine.

Vapors generated in fuel tank 20 may be routed to fuel vapor canister 22, via conduit 31, before being purged to engine intake 23. Fuel tank 20 may include one or more vent valves for venting diurnals and refueling vapors generated in the fuel tank to fuel vapor canister 22. The one or more vent valves may be electronically or mechanically actuated valve and may include active vent valves (that is, valves with moving parts that are actuated open or close by a controller) or passive valves (that is, valves with no moving parts that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system. Also, the wiring required to couple such electronic vent valves to the controller may act as a potential ignition source inside the fuel tank, increasing fire hazards in the fuel system.

Returning to FIG. 1, fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23, specifically intake manifold 44, via purge line 28 by opening canister purge valve 112. While a single canister 22 is shown, it will be appreciated that fuel system 18 may include any number of canisters.

Canister 22 includes a vent 27 (herein also referred to as a fresh air line) for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. By closing canister vent valve 114, the fuel tank may be isolated from the atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, in some embodiments, a fuel tank isolation valve (not shown) may be optionally included in conduit 31 such that fuel tank 20 is coupled to canister 22 via the isolation valve. When included, the isolation valve may be kept closed during engine operation so as to limit the amount of diurnal vapors directed to canister 22 from fuel tank 20. During refueling operations, and selected purging conditions, the isolation valve may be temporarily opened to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled between the fuel tank and canister 22, in alternate embodiments, the pressure sensor may be directly coupled to fuel tank 20.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

As such, if any of the canister purge valve or canister vent valve is degraded (e.g., stuck open or stuck closed), excessive vacuum can result in the fuel tank. This can harm and damage the fuel tank if not addressed. While various pressure relief valves and vent valves are coupled to the fuel system to reduce the build-up of pressure (positive or negative pressure) in the fuel tank, the inventors herein have recognized that there may be conditions where due to hardware malfunction, adequate pressure relief via the pressure relief valve(s) is not achieved. Accordingly, to reduce the likelihood of excess vacuum induced fuel tank damage, the canister purge valve may be opened in response to a rise in fuel tank vacuum so as to dissipate the excess vacuum to the engine intake manifold. As elaborated at FIGS. 2-3, the vacuum may be dissipated while the engine is not combusting. For example, where the vehicle system is a hybrid vehicle system, the canister purge valve may be opened to dissipate the excess vacuum to the intake manifold after shifting the vehicle from an engine mode of operation to a battery (or electric) mode of operation. As another example, where the engine is selectively deactivatable, the canister purge valve may be opened after an idle-stop operation has been initiated (that is, while the engine is spinning to rest unfueled or after the engine has spun to rest). By venting the excess vacuum to the intake manifold while the engine is not combusting, air-fuel errors that would have been incurred from the vacuum dissipation are reduced. As one example, an excessive vacuum condition could be a result of any type of blockage in the fuel lines between the fuel tank, through the canister to atmosphere. The blockage could be temporary (e.g., due to snow or water) or permanent as a result of dirt/dust contamination or a CVV stuck closed. As such, if the cause of the excess fuel tank vacuum is due to a leaky CPV, the instant that the engine pulls down, the fuel tank vacuum will dissipate without requiring the CPV to be commanded open. However, if the fuel tank vacuum does not dissipate when the engine is pulled down, the CPV may be commanded open. Herein, even with the leaky SPV, by commanding the CPV open, faster dissipation of fuel tank vacuum is achieved.

The vacuum may alternatively be dissipated to the intake manifold while the engine is running, while compensating for air disturbances caused by the dissipated vacuum. For example, as elaborated at FIGS. 4-5, concomitant throttle or fuel injection adjustments may be made to reduce air-fuel errors.

Figure 2:
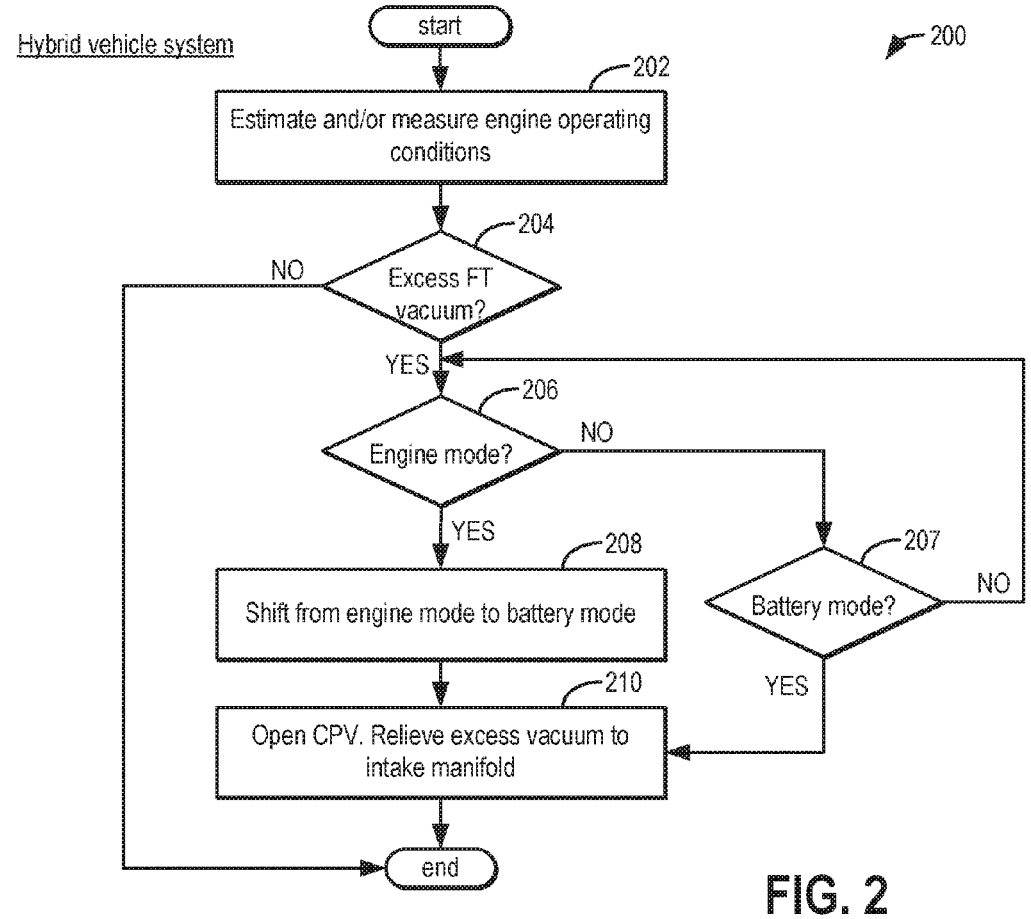
FIGS. 2-4 show high level flow charts of example routines that may be implemented for venting excess fuel tank vacuum to an engine intake manifold.
Figure 4:
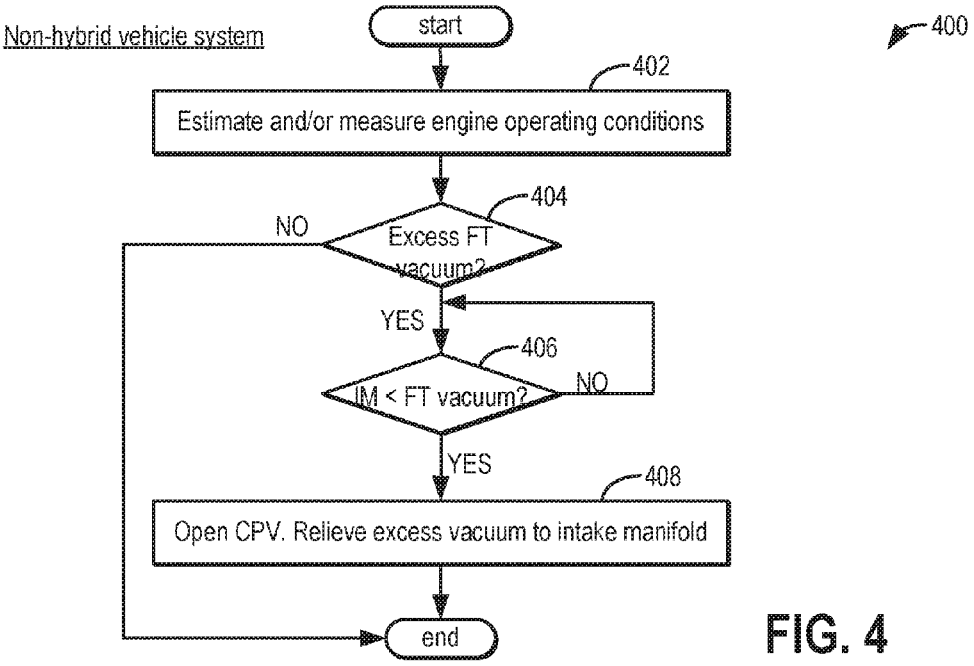
Figure 3:
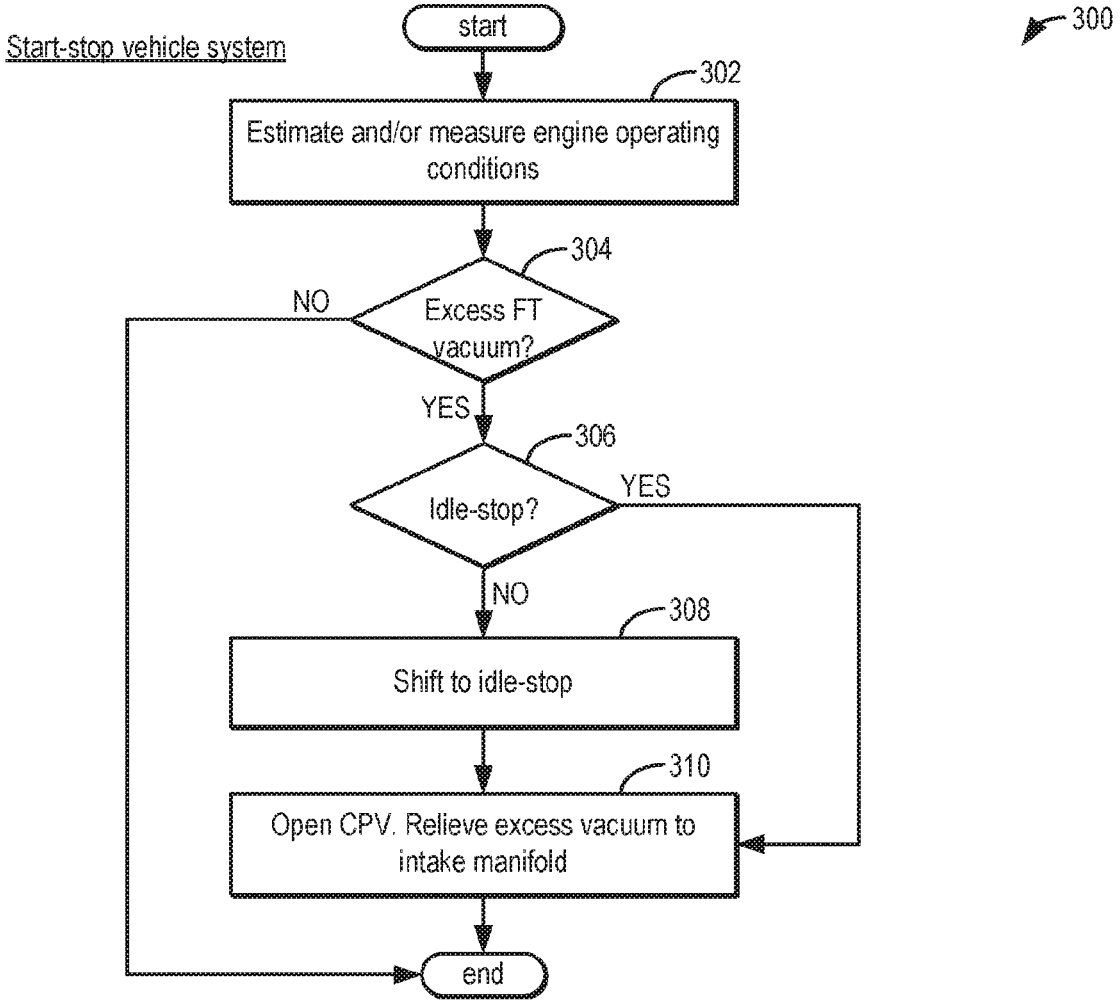
Figure 5:
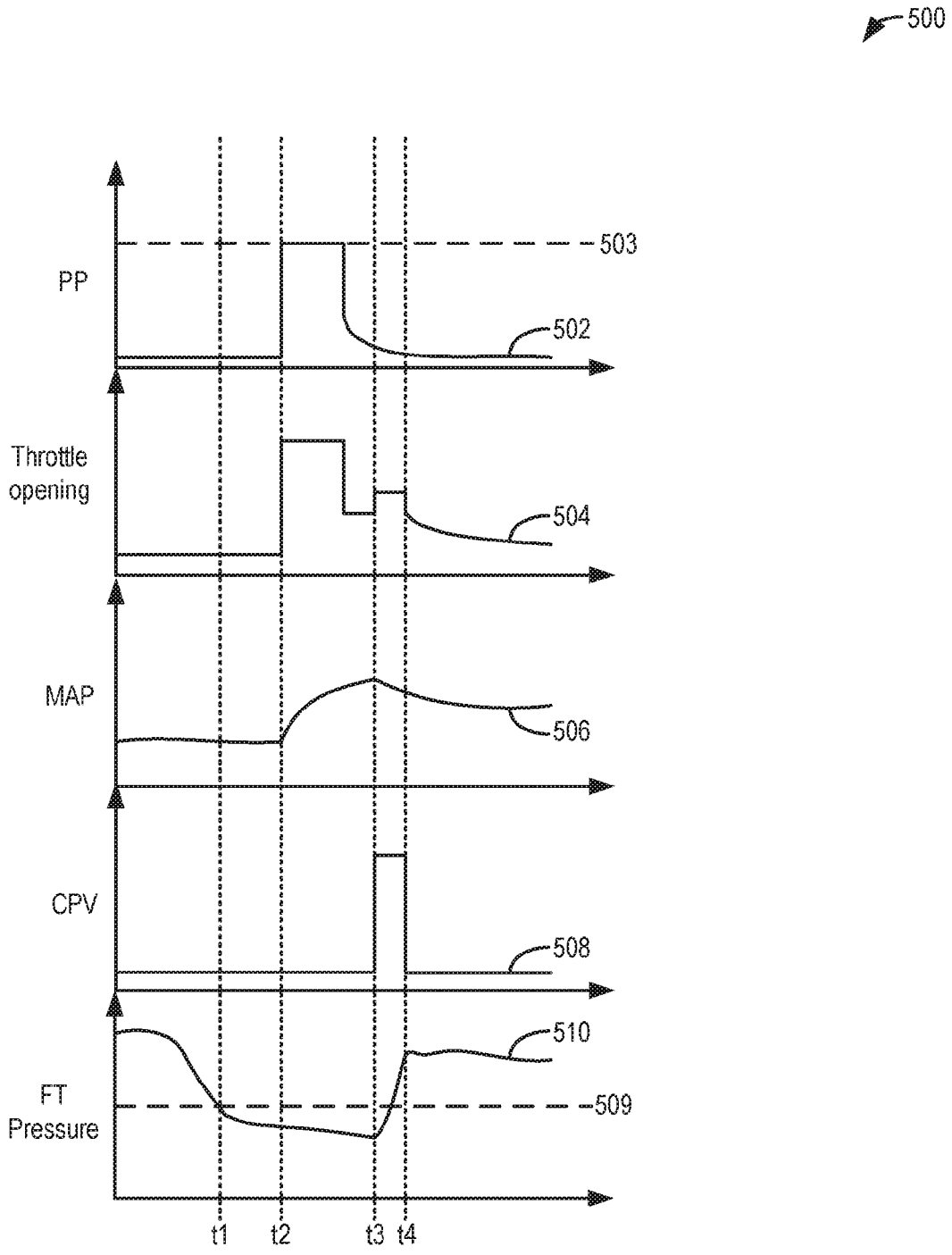
FIG. 5 shows an example canister purge valve operation that may be performed to relieve excess fuel tank vacuum, according to the present disclosure.

It will be appreciated that while the depicted embodiment of fuel system 18 includes various vent valves and pressure relief valves to relieve fuel tank pressure, and uses the combination of the pressure relief valves and the opening of the canister purge valve to maintain fuel tank pressures, in alternate embodiments, the fuel system may have fewer pressure relief valves (e.g., no pressure relief valves) and may rely only on the opening of the canister purge valve, as elaborated at FIGS. 2-4, to provide pressure relief.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas (air/fuel ratio) sensor 126 located upstream of the emission control device, exhaust temperature sensor 128, MAP sensor 118, and exhaust pressure sensor 129. Other sensors such as additional pressure, temperature, air/fuel ratio, and composition sensors may be coupled to various locations in the vehicle system 6. As another example, the actuators may include fuel injector 66, canister purge valve 112, canister vent valve 114, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 2-4.

In this way, the system of FIG. 1 enables a method for a fuel system coupled to an engine wherein, in response to fuel tank vacuum level (e.g., in response to fuel tank vacuum level being higher than a threshold level and/or in response to a rise in fuel tank vacuum level being higher than a threshold rate), a canister purge valve is opened to dissipate excess fuel tank vacuum into an engine intake manifold. A timing of the opening of the canister purge valve may be based on engine operating conditions. For example, if the indication of excess fuel tank vacuum is received while a hybrid vehicle is in an engine mode, the vacuum may be dissipated to the intake while the engine is not combusting, after shifting the vehicle to a battery mode. As another example, the engine may be selectively deactivated before opening the purge valve. Alternatively, the excess fuel tank vacuum may be dissipated into the intake manifold of a combusting engine with concomitant fuel and/or air adjustments performed to reduce air-fuel ratio errors.

Now turning to FIG. 2, an example routine 200 is shown for venting excess fuel tank vacuum to an engine intake in a hybrid vehicle system.

At 202, vehicle operating conditions may be estimated and/or measured. These may include, for example, a vehicle mode of operation, driver demand, vehicle speed, battery state of charge, engine speed, ambient conditions, engine temperature, fuel level, fuel tank pressure and temperature, fuel tank vacuum level, etc. At 204, it may be determined if there is excess fuel tank vacuum. In particular, it may be determined if the estimated fuel tank vacuum level is higher than a threshold level (for example, higher than 16 InH2O or an alternate limit set by the detecting sensor range capability or system hardware constraint) and/or a rise in fuel tank vacuum level is higher than a threshold rate (for example, higher than 4 InH2O or 8 InH20/sec). If the fuel tank vacuum level or the rate of rise in the fuel tank vacuum level is elevated, it may be determined that there is excessive fuel tank vacuum. If not, the routine may end.

Upon confirmation, at 206, it may be determined if the vehicle is operating in the engine mode. For example, it may be determined if the engine is combusting and the vehicle is being propelled, at least in part, by power derived from the combusting engine. If yes, then at 208, the routine includes shifting the vehicle from the engine mode to a battery mode of operation. That is, the engine may be deactivated and the vehicle may be propelled completely using power derived from the system battery. Next at 210, the routine includes, in response to the elevated fuel tank vacuum level, opening a canister purge valve to dissipate the excess fuel tank vacuum into the engine intake manifold. Herein, a timing of opening of the canister purge valve is adjusted based on a hybrid electric vehicle mode of operation such that the vacuum is vented to the engine intake manifold while the engine is not combusting. Thus, when an indication that the fuel tank vacuum is higher than the threshold level is received while the hybrid electric vehicle is in an engine mode of operation, the canister purge valve is opened only after shifting the vehicle from the engine mode to a battery mode of operation. As used herein, opening the canister purge valve includes transiently opening the canister purge valve until the fuel tank vacuum is lower than the threshold level. The controller may then close the canister purge valve and resume engine combustion. For example, after venting the excess vacuum, the engine mode of operation may be resumed.

It will be appreciated that while the depicted example suggests shifting the vehicle mode of operation from the engine mode to the battery mode in response to the elevated fuel tank vacuum level, in alternate examples, the controller may wait for the vehicle to shift to the battery mode of operation (due to vehicle operating conditions other than the fuel tank vacuum level) and opportunistically vent the fuel tank vacuum during that battery mode of operation. For example, while the fuel tank vacuum level is above a first, lower threshold but below a second, higher threshold, the controller may wait for the next available battery mode of operation. In comparison, when the fuel tank vacuum level is above the second threshold, the controller may shift the vehicle from the engine mode to the battery mode to enable immediate vacuum venting and reduce the likelihood of fuel tank vacuums exceeding a threshold in which damage could occur.

Returning to 206, if the engine mode is not confirmed, at 207, a battery mode may be confirmed. If the battery mode is confirmed, the routine directly proceeds to 210 to open the canister purge valve and vent fuel tank vacuum to the engine intake.

In this way, a timing of the opening of the canister purge valve is adjusted based on engine operating conditions (herein vehicle mode of operation) so that vacuum is dissipated to a deactivated engine. This allows air disturbances and consequent air-fuel ratio errors to be reduced.

In one example, a fuel system is coupled to an engine in a hybrid electric vehicle. In response to fuel tank vacuum being higher than a threshold level when the vehicle is operating in an engine mode, a controller may open a canister purge valve to dissipate excess fuel tank vacuum to an engine intake when the vehicle is operating in a battery mode. Herein, in response to the fuel tank vacuum being higher than the threshold level, and before opening the canister purge valve, the controller may shift the vehicle from the engine mode of operation to the battery mode of operation.

Now turning to FIG. 3, an example routine 300 is shown for venting excess fuel tank vacuum to an engine intake in a start-stop vehicle system. As such, the start-stop vehicle system includes an engine that is selectively deactivatable in response to idle-stop conditions.

At 302, engine operating conditions may be estimated and/or measured. These may include, for example vehicle speed, driver demand, engine speed, ambient conditions, engine temperature, fuel level, fuel tank pressure and temperature, fuel tank vacuum level, etc. At 304, it may be determined if there is excess fuel tank vacuum. In particular, it may be determined if the estimated fuel tank vacuum level is higher than a threshold level (for example, higher than 16 InH2O) and/or a rise in fuel tank vacuum level is higher than a threshold rate (for example, higher than 4 In H2O or 8 InH20/sec). If the fuel tank vacuum level or the rate of rise in the fuel tank vacuum level is elevated, it may be determined that there is excessive fuel tank vacuum. If not, the routine may end.

Upon confirmation, at 306, it may be determined if the engine is in an idle-stop status. In one example, the engine may be in idle-stop if the engine is selectively deactivated with the vehicle in key-on. The engine may be selectively and automatically deactivated responsive to idle-stop conditions by deactivating cylinder fuel (via deactivatable fuel injectors) and spark. As such, the engine may be automatically (e.g., without driver input) shifted to an idle-stop responsive to one or more idle-stop conditions being met, such as the engine combusting while a system battery (or energy storage device) is sufficiently charged, auxiliary engine loads (e.g., air conditioning requests) being low, engine temperatures (intake temperature, catalyst temperature, coolant temperature, etc.) being within selected temperature ranges where further regulation is not required, and driver demand being sufficiently low. If the engine is not in idle-stop, then at 308, the routine includes initiating a shift to idle-stop by deactivating cylinder fuel and spark. The engine may then start to spin to rest. Alternatively, the controller may wait for the vehicle to reach an idle status with the engine not running.

Next at 310, the routine includes, in response to the elevated fuel tank vacuum level, opening a canister purge valve to dissipate the excess fuel tank vacuum into the engine intake manifold. Herein, a timing of opening of the canister purge valve is adjusted such that the canister purge valve is opened only after selectively deactivating the engine. This may include opening the canister purge valve while the engine is spinning to rest unfueled, or while the engine is at rest. As a result of the opening, the vacuum is vented to the engine intake manifold while the engine is not combusting. As used herein, opening the canister purge valve includes transiently opening the canister purge valve until the fuel tank vacuum is lower than the threshold level. The controller may then close the canister purge valve and resume engine combustion. For example, after venting the excess vacuum, the engine may be restarted, if required.

It will be appreciated that while the depicted example suggests shifting the engine to an idle-stop in response to the elevated fuel tank vacuum level, in alternate examples, the controller may wait for the vehicle to be in an idle state with the engine not running (e.g., due to idle-stop conditions being met) and opportunistically vent the fuel tank vacuum during that idle state. For example, while the fuel tank vacuum level is above a first, lower threshold but below a second, higher threshold, the controller may wait for the next available idle-stop. In comparison, when the fuel tank vacuum level is above the second threshold, the controller may shift the vehicle to an idle-stop to enable immediate vacuum venting. As such, the forced operation would only be a result if potential for hardware damage is present. Otherwise, the driver demand would always be honored (i.e. if vehicle acceleration is requested).

Returning to 306, if an idle-stop is confirmed, the routine directly proceeds to 310 to open the canister purge valve and vent fuel tank vacuum to the engine intake.

In this way, a timing of the opening of the canister purge valve is adjusted based on engine operating conditions (herein selective deactivation of engine) so that vacuum is dissipated to a deactivated engine. This allows air disturbances and consequent air-fuel ratio errors to be reduced.

In one example, a fuel system is coupled to an engine having selectively deactivatable fuel injectors. In response to fuel tank vacuum being higher than a threshold level while the engine is combusting, a controller may selectively deactivate the engine and open a canister purge valve to dissipate excess fuel tank vacuum after the deactivation. Herein, selectively deactivating the engine includes selectively deactivating engine fuel injectors. Further, opening the canister purge valve to dissipate excess fuel tank vacuum after the deactivation includes opening the canister purge valve while the engine is spinning to rest unfueled or after the engine has spun to rest.

Now turning to FIG. 4, an example routine 400 is shown for venting excess fuel tank vacuum to an engine intake in a non-hybrid vehicle system. As such, the non-hybrid vehicle system includes a conventional internal combustion engine.

At 402, engine operating conditions may be estimated and/or measured. These may include, for example vehicle speed, driver demand, engine speed, ambient conditions, engine temperature, fuel level, fuel tank pressure and temperature, fuel tank vacuum level, etc. At 404, it may be determined if there is excess fuel tank vacuum. In particular, it may be determined if the estimated fuel tank vacuum level is higher than a threshold level (for example, higher than 16 InH2O) and/or a rise in fuel tank vacuum level is higher than a threshold rate (for example, higher than 4 In H2O or 8 InH20/sec). If the fuel tank vacuum level or the rate of rise in the fuel tank vacuum level is elevated, it may be determined that there is excessive fuel tank vacuum. If not, the routine may end.

Upon confirmation, at 406, it may be determined if intake manifold (IM) vacuum is lower than the fuel tank vacuum. If not, the routine may wait for the next available opportunity where the intake manifold vacuum is lower than the fuel tank vacuum.

Next at 408, the routine includes, in response to the rise in fuel tank vacuum above a threshold, opening the canister purge valve to dissipate excess fuel tank vacuum into an engine intake manifold. Herein, the vacuum is dissipated into a combusting engine and therefore a timing of the opening is adjusted based on intake manifold vacuum so as to reduce air-fuel disturbances. In one example, opening the canister purge valve after the intake manifold vacuum is lower than the fuel tank vacuum includes opening the canister purge valve following a tip-in where a pedal position is displaced by more than a threshold amount (e.g., a throttled pedal aggressive tip-in). In some examples, during the opening, the controller may perform concomitant air and/or fuel adjustments to enable engine output torque to be maintained while the vacuum is vented. As an example, during the opening, a controller may adjust an intake throttle position based on the dissipated fuel tank vacuum (while maintaining cylinder fuel injection) so as to maintain engine combustion air-fuel ratio (e.g., at or around stoichiometry). As another example, during the opening, the controller may adjust cylinder fuel injection based on the dissipated fuel tank vacuum (while maintaining an intake throttle position) so as to maintain engine combustion air-fuel ratio (e.g., at or around stoichiometry). As used herein, opening the canister purge valve includes transiently opening the canister purge valve until the fuel tank vacuum is lower than the threshold level. The controller may then close the canister purge valve and resume throttle and fuel injection settings.

In this way, a timing of the opening of the canister purge valve is adjusted based on intake manifold vacuum so that vacuum is dissipated to the combusting deactivated engine when air-fuel ratio errors are lower or better tolerated and while torque disturbances are reduced.

It will be appreciated that if the cause of an excess fuel tank vacuum is due to a leaky CPV, the instant that the engine pulls down, the fuel tank vacuum will dissipate without requiring the CPV to be commanded open. However, if the fuel tank vacuum does not dissipate when the engine is pulled down, the CPV may be commanded open. Herein, even with the leaky SPV, by commanding the CPV open, faster dissipation of fuel tank vacuum is achieved.

An example adjustment that may be performed in a non-hybrid vehicle system is now depicted with reference to the example of FIG. 5. Specifically, map 500 depicts (accelerator) pedal position (PP) at plot 502, throttle position adjustments at plot 504, manifold pressure (MAP) at plot 506, canister purge valve (CPV) operation at plot 508, and fuel tank pressure levels at plot 510.

Prior to t1, fuel tank pressure (plot 510) may be above a threshold level 509, for example, at atmospheric conditions. Between t0 and t1, however, due to degradation of a valve in the fuel system, or a restriction in the fuel system's fresh air line, fuel tank pressure may start to drop. At t1, fuel tank pressure may drop such that fuel tank vacuum levels may start to rise, and it may be determined that fuel tank venting is required and the controller may wait for an opportunity to vent the excess vacuum from the fuel tank to the engine intake manifold.

At t2, an aggressive tip-in may occur wherein the operator may apply the accelerator pedal (plot 502) to request a substantial increase in torque. In particular, the operator may displace the pedal to a threshold pedal position 503. In response to the increased torque demand, an intake throttle may be shifted to a more open position (plot 504) to provide more air, as reflected by the consequent increase in MAP (plot 506). Sometime after t2, the operator may release the pedal and the throttle opening may be corresponding decreased. MAP may also correspondingly reduce.

However, due to the aggressive tip-in, intake manifold vacuum may be lower than fuel tank vacuum and conditions may be present for venting the excess fuel tank vacuum to the engine intake manifold. Consequently, at t3, the controller may open the canister purge valve (plot 508) to relieve the excess vacuum in response to which the fuel tank pressure may start to rise. In particular, the CPV may be opened for a duration between t3 and t4. At t4, in response to fuel tank pressure level rising above threshold 509 (or fuel tank vacuum levels falling), the CPV may be closed.

Between t3 and t4, in response to the vacuum venting, air may be drawn out of the intake manifold into the fuel tank. To reduce torque disturbances and air-fuel errors that could occur, an opening of the throttle may be transiently increased between t3 and t4 to compensate for the air being drawn out of the manifold into the fuel tank. As a result of the throttle adjustment, MAP disturbances are not seen between t3 and t4.

It will be appreciated that while the depicted example adjusts an intake throttle position based on the dissipated fuel tank vacuum while maintaining cylinder fuel injection to reduce air-fuel errors, in alternate examples, a cylinder fuel injection may be adjusted based on the dissipated fuel tank vacuum while maintaining the intake throttle position so as to reduce air-fuel ratio errors. It will also be appreciated that while the depicted example shows tank pressure control in response to a fuel tank over-vacuum condition, in other embodiments, the tank control may be in response to a fuel tank over-pressure condition.

In this way, excessive fuel tank vacuum levels observed during engine running may be rapidly and reliably identified. By venting the vacuum to the engine intake, fuel tank vacuum levels can be reduced before they reach levels that can damage the fuel tank. By venting excess fuel tank vacuum to an engine intake while the engine is not combusting, air flow disturbances can be reduced. Alternatively, the excess vacuum can be opportunistically vented to the engine intake of a combusting engine during selected tip-ins. By relieving vacuum during aggressive tip-ins, air flow disturbances resulting from the release of vacuum into the engine intake are reduced, leading to fewer torque errors and air-fuel ratio errors. Overall, fuel tank degradation can be reduced while fuel system integrity is enabled and without degrading engine performance.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A method for a fuel system coupled to an engine in a hybrid electric vehicle, comprising:

in response to fuel tank vacuum being higher than a threshold level when the vehicle is operating in an engine mode, opening a canister purge valve to dissipate excess fuel tank vacuum to an engine intake when the vehicle is operating in a battery mode.

2. The method of claim 1, further comprising, in response to the fuel tank vacuum being higher than the threshold level, and before opening the canister purge valve, shifting the vehicle from the engine mode of operation to the battery mode of operation.

* * * * *